US008098166B2

(12) United States Patent
Lang

(10) Patent No.: US 8,098,166 B2
(45) Date of Patent: Jan. 17, 2012

(54) VARIABLE AIR SPEED ASPIRATING SMOKE DETECTOR

(75) Inventor: Scott Lang, Geneva, IL (US)

(73) Assignee: Honeywell International Inc., Morristown, NJ (US)

( * ) Notice: Subject to any disclaimer, the term of this patent is extended or adjusted under 35 U.S.C. 154(b) by 373 days.

(21) Appl. No.: 12/428,972

(22) Filed: Apr. 23, 2009

(65) Prior Publication Data

US 2010/0271219 A1 Oct. 28, 2010

(51) Int. Cl.
*G08B 21/00* (2006.01)

(52) U.S. Cl. ..... 340/628; 340/629; 340/630; 73/28.01

(58) Field of Classification Search ..... 340/627–630, 340/632–634; 73/28.01
See application file for complete search history.

(56) References Cited

U.S. PATENT DOCUMENTS

| | | | | |
|---|---|---|---|---|
| 4,254,414 | A | 3/1981 | Street et al. | |
| 7,224,285 | B2 | 5/2007 | Tiwet et al. | |
| 7,262,705 | B2 | 8/2007 | Back et al. | 340/628 |
| 2007/0008157 | A1 | 1/2007 | Siemens et al. | 340/577 |

FOREIGN PATENT DOCUMENTS

GB 2 394 043 A 4/2004

OTHER PUBLICATIONS

European Search Report corresponding to Application No. EP 10 16 0038, dated Jul. 8, 2010.
Communication; European Search Report; Jul. 8, 2010; pp. 1-3; Appln No. EP 10 16 0038; Place: The Hague; Rijswijk, Netherlands.

*Primary Examiner* — Jeffery Hofsass
(74) *Attorney, Agent, or Firm* — Husch Blackwell

(57) ABSTRACT

An aspirated smoke detector includes a smoke sensor, an aspirator and variable speed control circuits. As the concentration of smoke increases, the speed control circuits can increase aspirator speed from a first, nominal value to a second, higher value.

17 Claims, 3 Drawing Sheets

VARIABLE AIR SPEED ASPIRATING SMOKE DETECTOR

FIELD

The invention pertains to aspirating smoke detectors. More particularly, the invention pertains to such detectors which include variable speed control circuitry.

BACKGROUND

Aspirated smoke detectors use a network of pipes to sample air from a large area and use a highly sensitive central detector. One of the problems with aspirated smoke detectors is the time that it takes for smoke to travel from the sampling port to the central detector (transport time). A fan or blower is required to move the air toward the detector.

On one hand, it would be desirable to operate the blower at a high speed to reduce the transport time. However, operating the blower at a reduced speed will increase its life span and decrease power consumption. Decreased power consumption means that the system will require less battery capacity for situations when main power fails.

There is a need to take advantage of performance provided by higher fan, or blower speeds while at the same time taking advantage of longer operating life and reduced power consumption provided by operating at lower speeds.

DETAILED DESCRIPTION

Figure 1A:
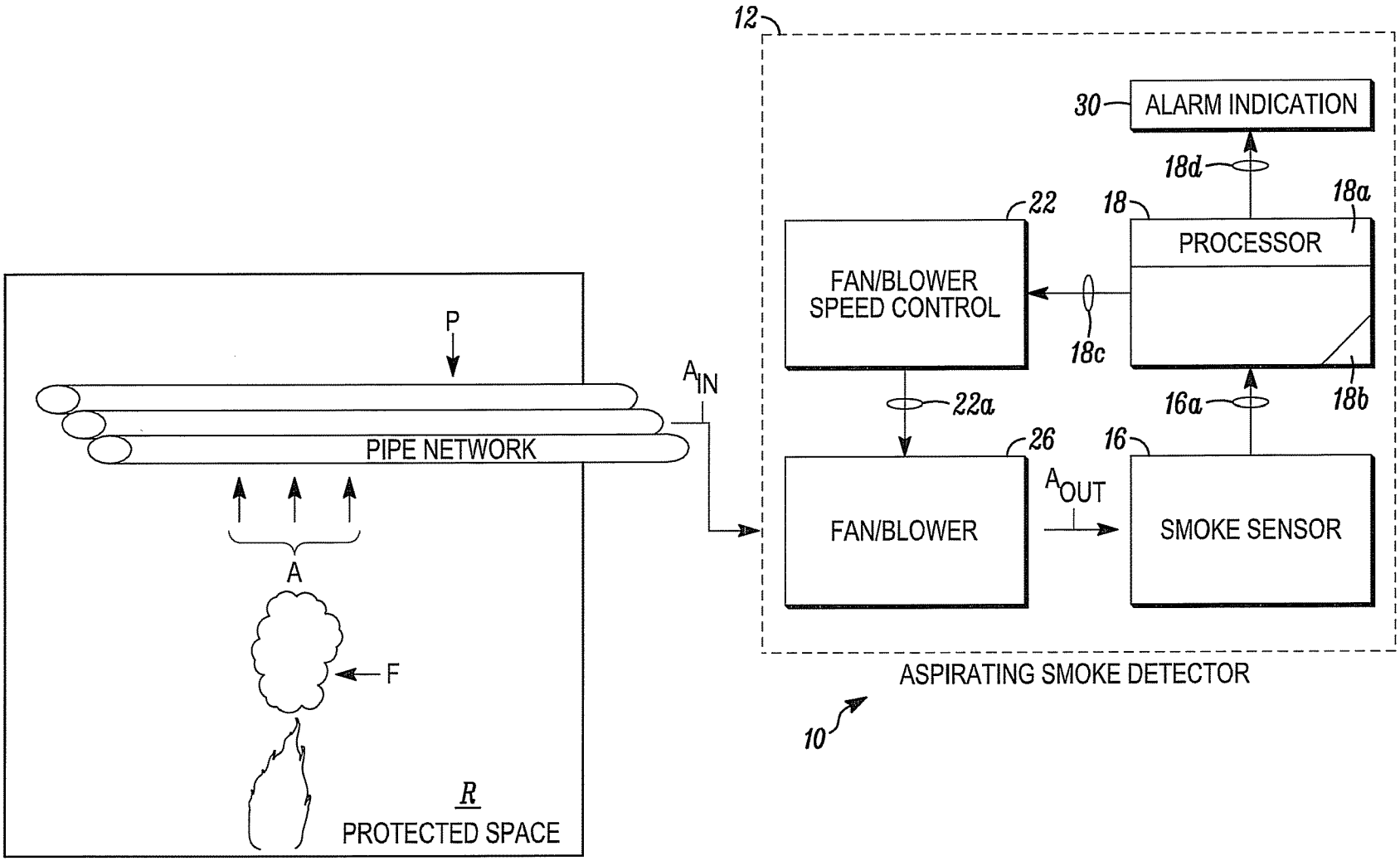
FIG. 1A is a block diagram of a detector which embodies the invention.

While embodiments of this invention can take many different forms, specific embodiments thereof are shown in the drawings and will be described herein in detail with the understanding that the present disclosure is to be considered as an exemplification of the principles of the invention, as well as the best mode of practicing same, and is not intended to limit the invention to the specific embodiment illustrated.

Embodiments of the invention advantageously have the capability of operating a blower, or, fan in an aspirating smoke detection system at two or more speeds. A higher fan speed decreases the time it takes for air samples to reach a central, or common, smoke detector.

In accordance with the invention, increasing the fan speed upon detection of an increased level of sensed particulate matter will speed a determination as to whether smoke is present (and persistent or increasing) or if the sensed particulate represents a short term false alarm condition.

Known aspirated systems work by establishing pre-alarm and alarm thresholds at very high sensitivities i.e., low obscuration levels. When pre-alarm levels are reached, the system will typically wait for the obscuration level to increase (indicating possible fire) or decrease (indicating a false alarm). Increasing the fan speed will speed this determination.

Increasing the system air speed once particulate is detected may aid in classifying particulate as either dust or smoke. Increasing the speed will change the behavior of larger (heavier) particles such as dust differently than lighter smoke particles. By evaluating the behavior of the particles in inertial particle separators at different speeds, size might be inferred.

In one aspect of the invention, speed of the blower, or, fan could be increased during commissioning in order to more quickly quantify the environment. Typically, aspirated systems will be installed for a period of time before firm alarm thresholds are determined. During the commissioning period a record is kept of background particulate levels and alarm thresholds are set accordingly.

Conversely, the air speed could be slowed down once particulate is persistently detected in order to allow the sensor to more carefully analyze the sample. Some aspirated detection systems are classifying the particulate in the sampled air by size. A slower speed may aid in the classification process by allowing more dwell time in the sensor i.e., more analysis on a homogeneous air sample.

FIG. 1A is a block diagram of an aspirating smoke detector 10 which embodies the invention. Detector 10 includes a housing 12 which carries a smoke sensor 16 which could be implemented as a photo-electric or an ionization-type smoke sensor without limitation. Signals from sensor 16 are coupled to control circuits 18.

Control circuits 18 could be implemented, at least in part, by a programmable processor 18*a* in combination with executable instructions or software 18*b*. Executable instructions or software 18*b* are stored on a computer readable medium accessible to the processor 18*a*.

Control circuits 18 provide output control signals 18*c* to a Fan/Blower Speed Control unit 22. Speed Control unit 22 responsive to signals 18*c* generates output control signals 22*a* to an aspiration unit, such as 26 which could be implemented as a fan or blower without limitation.

Figure 1B:
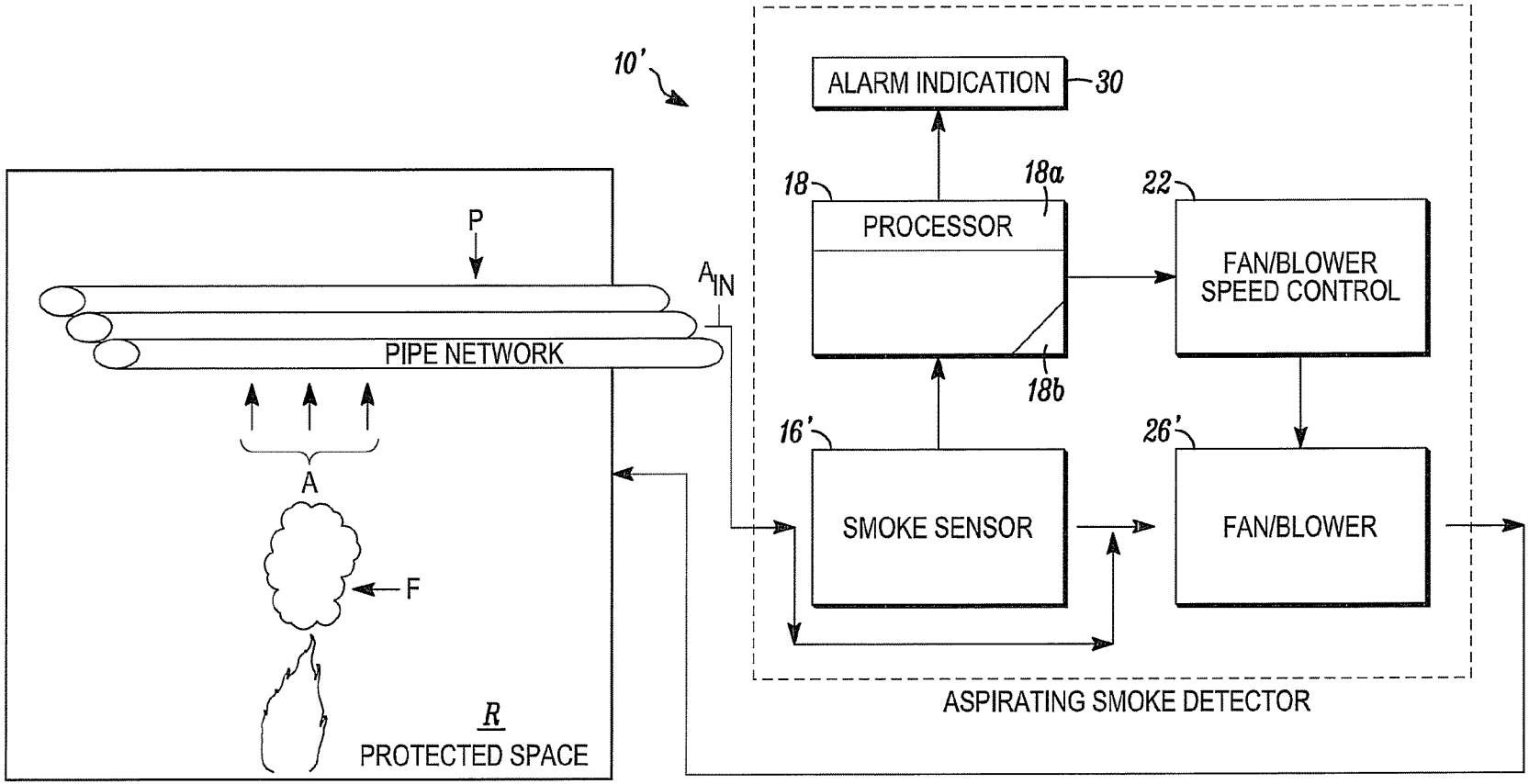
FIG. 1B is a block diagram of a second embodiment of the invention.

FIG. 1B illustrates a system 10' where the aspirator 26' is placed after the smoke sensor 16' and air is pulled through the smoke sensing chamber. Air exhausts back to the monitored space R. In this embodiment, a partial representative flow can be maintained through the sensor 16' in order to reduce contamination of the sensor 16' by airborne particulate normally in the atmosphere. Other elements of FIG. 1B correspond to elements of FIG. 1A and have been assigned the same identification numerals and need no further discussion.

As a speed parameter of the aspirator is increased, ambient air A from a monitored, or protected space R is drawn by a pipe network, indicated generally at P, at a higher rate of speed by blower 26 into sensor 16. Conversely, as the speed of unit 26 is decreased, output ambient air flows from that unit and is coupled to sensor 16 at a lower rate. As particulate matter from a fire condition F in region R increases, the speed of unit 26, in response to signal 16*a*, can also be altered, or, increased as explained below relative to the method 100 of FIG. 2.

Figure 2:
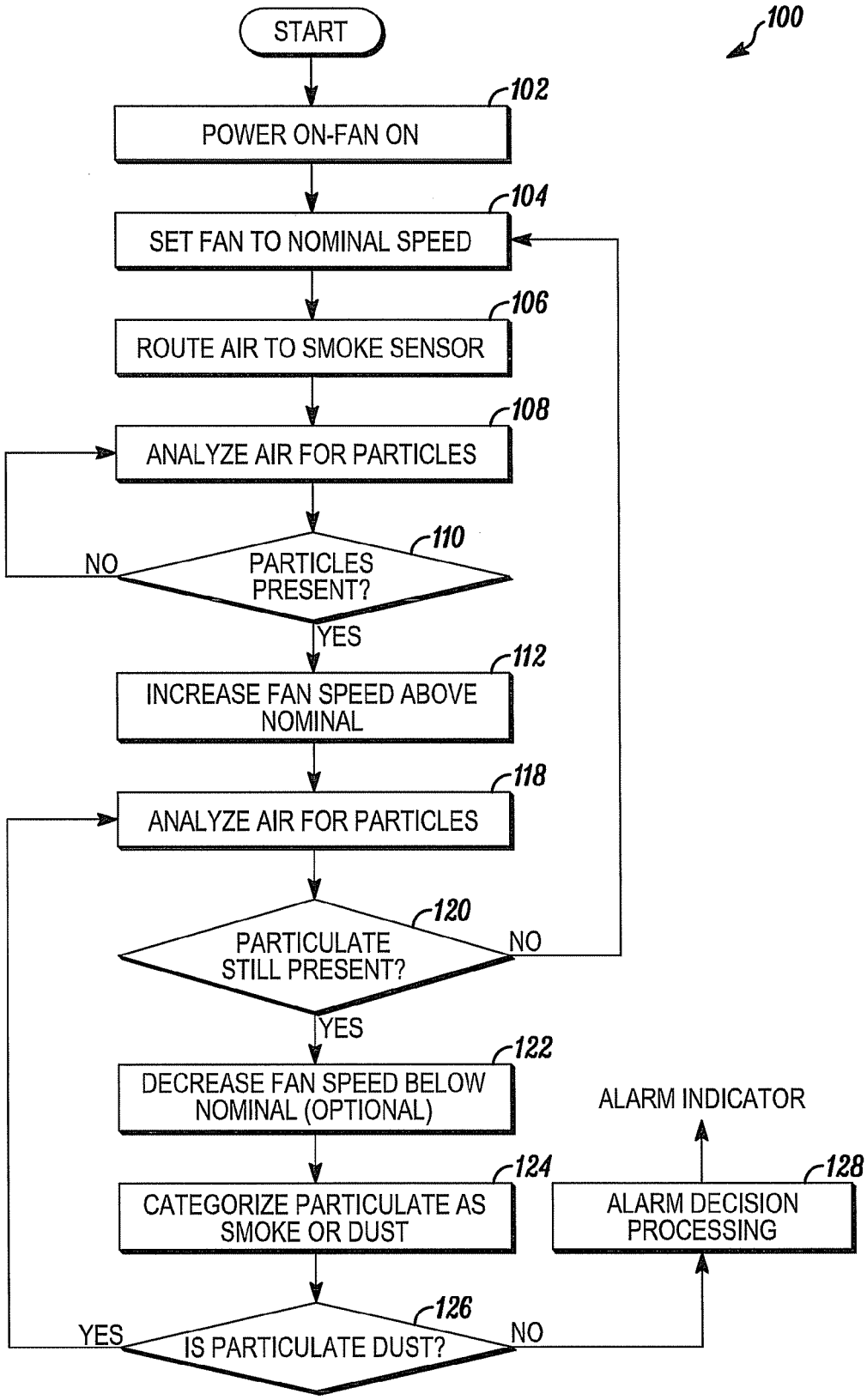
FIG. 2 is a flow diagram of a method of operating the detector of FIG. 1.

As illustrated in FIG. 2, initially unit 26 is energized, as at 102, and speed is set to a nominal value, as at 104. The aspirator 26 inputs ambient air from the region R into sensor 16, as at 106. Circuits 18 can analyze air sensed via sensors 16, as indicated by signals 16*a*, as at 108.

In the event that sufficient particulate material is present, as at 110, speed of the aspirating unit 26 can be increased from its initial nominal value, as at 112. In response to the increased aspirator speed, the circuits 18 can carry out an analysis, as at 118 of the incoming ambient to determine a concentration of airborne particulate matter. If particulate matter is no longer present, as at 120, aspirator speed can be returned to a nominal value, as at 104. Otherwise, speed can be reduced below nominal, as at 122.

Subsequent the particulate matter can be categorized as smoke or dust as at 124. If dust, analysis can continue, as at 118. Alternately, the particulate matter can be evaluated to determine if an alarm indicator should be issued, or not as at 128.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A detector comprising:

a smoke sensor with a gas inflow port;

a variable speed aspirator coupled to the sensor; and control circuits coupled to the sensor and the aspirator, and responsive to a sensed smoke indicator, the control circuits change an aspirator speed parameter from one value to another and where the control circuitry carries out a determination as to whether dust is present in the sensor.

2. A detector as in claim 1 where the smoke sensor comprises one of an ionization-type or a photo-electric-type smoke sensor.

3. A detector as in claim 1 where the control circuits increase the speed parameter from one value to a second, greater value.

4. A detector as in claim 1 where the control circuits evaluate the sensed smoke indicator relative to a pre-alarm threshold, and responsive to that evaluation, increase the speed parameter from a first to a second, greater, value.

5. A detector as in claim 1 where, responsive to a selected decrease in the sensed smoke indicator, the speed parameter is decreased from one value to a second lower value.

6. A detector as in claim 1 which includes at least one ambient air inflow conduit coupled to the inflow port.

7. An aspirated detector comprising:

a housing;

a particulate sensor carried by the housing;

a variable speed aspirator; and aspirator speed control circuits, coupled between the particulate sensor and the aspirator, and responsive to detecting the presence of particulate matter, the speed control circuits alter aspirator speed and categorize the particulate matter if dust.

8. A detector as in claim 7 where the speed control circuits increase the aspirator speed from a first value to a second, higher, value in response to particulate concentration.

9. A detector as in claim 8 where the circuits evaluate sensed airborne particulate matter, and responsive thereto, reduce aspirator speed below the first value.

10. A method comprising:

establishing an initial speed of atmospheric flow into a sensing region;

sensing, at the sensing region, airborne particulate matter;

determining if a predetermined concentration of particulate matter is being sensed;

responsive to the determining, increasing the speed of atmospheric flow into the sensing region;

conducting a further analysis of particulate concentration; and responsive to the continuing presence of particulate matter, decreasing the speed of atmospheric flow into the sensing region below the initial speed.

11. A method as in claim 10 which includes:

determining if the airborne particulate matter is one of smoke or dust;

responsive to a determination that the particulate matter comprises smoke, determining if a fire condition is present.

12. A method as in claim 11 which includes, responsive to a determination that the particulate matter comprises dust, continuing to analyze the inflowing atmospheric flow.

13. A detector comprising:

a housing;

an airflow input port defined by the housing;

a variable speed aspirator with an airflow intake and an airflow output;

a smoke sensor in flow communication with one of the airflow intake, or the airflow output;

speed control circuits coupled between the aspirator and the smoke sensor, and responsive to an output signal from the smoke sensor, the speed control circuits increase aspirator speed from an initial value to a higher value and which includes airborne particulate analysis circuits which are coupled between the output signal from the smoke sensor and the speed control circuits and where the analysis circuits, prior to determining if a fire condition is present, reduce aspirator speed below the initial value.

14. A detector as in claim 13 where the analysis circuits, in response to increasing particulate concentration in the smoke sensor, determines if a fire condition is present.

15. A detector as in claim 14 where in response to the absence of a fire condition, the analysis circuits reduce aspirator speed.

16. A method of operating a detector as in claim 13 comprising:

establishing an initial speed of atmospheric flow into a sensing region;

sensing, at the sensing region, airborne particulate matter;

establishing a baseline level of particulate matter in the region; and setting an alarm threshold based on the baseline and decreasing the speed of atmospheric flow into the sensing region below the initial speed.

17. A detector as in claim 7 where the circuits continue to analyze for particulate matter in response to the dust.

* * * * *